United States Patent [19]

Kingelin

[11] 4,134,452

[45] Jan. 16, 1979

[54] WELL TESTING TOOL

[75] Inventor: George F. Kingelin, Rosenberg, Tex.

[73] Assignee: Gulf Research & Development Company, Pittsburgh, Pa.

[21] Appl. No.: 833,183

[22] Filed: Sep. 14, 1977

[51] Int. Cl.[2] ..... E21C 23/02

[52] U.S. Cl. ..... 166/133; 166/136; 166/332

[58] Field of Search ..... 166/133, 135, 136, 192, 166/188

[56] References Cited

U.S. PATENT DOCUMENTS

| | | | |
|---|---|---|---|
| 2,577,068 | 12/1951 | Baker | 166/237 |
| 2,928,469 | 3/1960 | Crowe | 166/135 |
| 3,002,563 | 10/1961 | Crowe | 166/135 |
| 3,042,116 | 7/1962 | Sharp et al. | 166/133 |
| 3,633,668 | 1/1972 | Vazquez | 166/135 |
| 4,007,783 | 2/1977 | Amancharla et al. | 166/135 |
| 4,044,827 | 8/1977 | Kerzee et al. | 166/133 |

*Primary Examiner*—Ernest R. Purser

[57] ABSTRACT

A tool for testing conditions at a specific depth in a well is run into the well on a wire line. The tool includes a stem having sealing rings around its outer surface adapted to seal against the inner wall of a locking assembly mounted on the lower end of a locking mandrel landed in a landing nipple in tubing in the well. The stem is locked in the locking assembly by dogs that move radially from a locking position preventing movement of the stem to a nonlocking position permitting pulling of the stem from the locking mandrel. The locking assembly includes an adapter that allows a single size stem to be used with a locking mandrel of any size.

16 Claims, 3 Drawing Figures

WELL TESTING TOOL

BACKGROUND OF THE INVENTION

This invention relates to the production of oil, gas or water from wells and more particularly to apparatus that is useful for measuring conditions existing at a specific depth in the well and is capable of being run into a well, set, and retrieved from the well on a wire line.

Occasionally it is necessary to run a tool into a well and set the tool to isolate that part of the well below the tool from that part of the well above the tool. For example, it may be desirable to measure the temperature or pressure of well fluids at a specific depth in the well. On some occasions it is desirable to direct all of the flow upwardly through a well at a selected depth through a flow meter to obtain information of value in production of fluids from the well. After the testing of the well has been completed, the tools or instruments used in the testing are removed either to remove obstructions to flow or to permit running other tools into the well. It is desirable that the tools or instruments used in the testing be capable of being run into the well, set, operated and retrieved by wire line to leave the well in a fully open condition that existed prior to the testing.

Isolation of a lower portion of a well from a higher portion is ordinarily accomplished by setting a packer in the well. Many packers are mechanically set by rotating a portion of the packer to cause a sleeve to move along threads and thereby exert forces against the ends of a sealing element that distort the sealing element to engage the inner wall of casing or other conduit in the well. To accomplsih the relative rotation of parts of the packer, such packers ordinarily are run into the well on tubing and include a friction element that will engage the wall of casing or other conduit in which it is set to prevent rotation of the packer as the tubing on which it is run into the well is rotated. Another type of packer is run into the well on tubing and a plug dropped into the packer to prevent flow through its lower end. Thereafter, liquid is pumped down the tubing to develop hydraulic pressure that moves piston-like elements that compress sealing elements to set the packer. Both the mechanically set packers and the hydraulically set packers require a rig for running tubing on which the packer is mounted into the well and removing it from the well after testing has been completed. If the testing is to extend over an appreciable period, the rig must either remain at the well during the testing or make a second trip for removal of the packer after the testing has been completed. If the packer is left in the well, it severely restricts the borehole opening and may interfere with subsequent production from the well. A mechanically set packer used to isolate the lower part of the well for a testing device is described in U.S. Pat. No. 2,702,474 of Johnston.

Wire line operated packers have been developed to avoid the cost of a derrick to run the packer and pull it when removal of the packer is desired. Such packers have a substantial length including slips and the sealing elements over which there is a very small clearance between the inner wall of the tubing and the packer. Because of the length of the wire line operated packers over which there is a very small clearance with the tubing, it is difficult to run the packers into tubing and often impossible to retrieve them. Bending, twisting or flattening of the tubing often prevents use of the wire line operated packers. Moreover, pitting, scoring or other damage to the tubing during use frequently prevents obtaining a seal which will allow the control needed for accurate tests of the well.

Electrically operated packers have been developed for use with sensitive electrical instruments requiring an electric line. Such packers are described in U.S. Pat. Nos. 3,503,444 and 3,542,126 of Arthur L. Owen. The packers are run to the desired depth on an electric wire line. An electric motor in the packer is then utilized to compress sealing means and move them outwardly against the wall of the tubing or casing in which the packer is set. In some instances, a motor-driven pump is used to inflate a flexible bag-type packer. U.S. Pat. Nos. 3,503,444 and 3,542,126 describe testing tools for measuring conditions at a specific depth in a well that utilize an electric motor to set the packer. These packers are also quite long, have a very small clearance and, additionally, require electrical power for operation. Loss of power after the packer is set can be disastrous.

In my copending U.S. patent application Ser. No. 645,420, filed Dec. 30, 1975, now U.S. Pat. No. 4,051,897 I have disclosed a tool that can be run into a well, landed and retrieved from the well after the well testing has been completed. The tool is landed in a conventional commercial locking mandrel that can also be run into a well on a wire line and landed in a landing nipple. A different sized tool of the type described in U.S. Pat. No. 4,051,897 is required for each different size of locking mandrel. U.S. Pat. No. 3,198,257 of Myers and U.S. Pat. No. 3,633,670 of Brown are pertinent patents cited during the prosecution of U.S. Pat. No. 4,051,897.

SUMMARY OF THE INVENTION

This invention resides in a well testing tool that can be used in a wide range of sizes of locking mandrels. The tool includes a locking assembly which is secured to the lower end of a locking mandrel. The locking assembly has a central bore extending longitudinally through its full length. A stem adapted to be run on a wire line extends through the locking assembly and has sealing rings that engage the wall of the central bore of the locking assembly to prevent flow between the stem and the locking assembly. A locking member forming a part of the locking assembly includes dogs that move radially on lifting the stem from a locking position engaging the locking device and the stem to a nonlocking position which permits withdrawal of the tool from the locking mandrel. A pressure relief passage allows equalization of pressure above and below the locking mandrel on lifting the tool to allow flow around sealing means and through the passage. In the preferred embodiment of the invention, the locking assembly includes at its upper end an adapter which is connected to the lower end of the locking mandrel. The adapter at the lower end of the locking mandrel permits a single size of stem to be used with any size of locking mandrel used with any of the sizes of tubing ordinarily used in oil or gas wells.

DESCRIPTION OF PREFERRED EMBODIMENT

Figure 1:
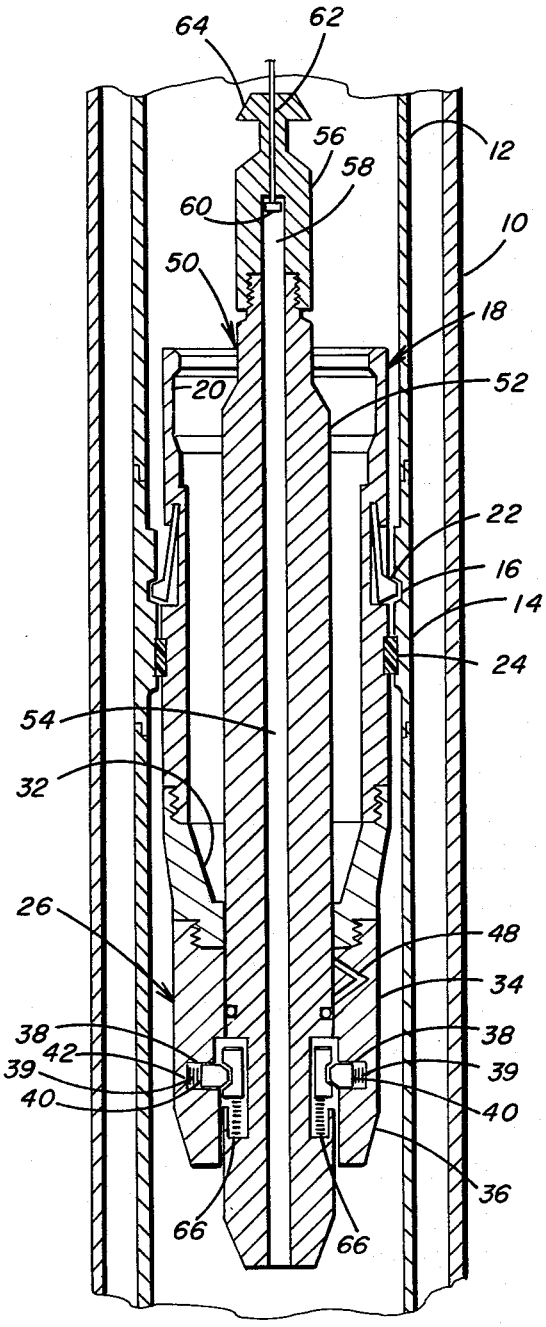
FIG. 1 is a diagrammatic vertical sectional view of the tool of this invention installed in a well.

Referring to FIG. 1 of the drawings, a portion of a well is shown with casing 10 set in the borehole of the well and a tubing string 12 run into the casing. The tubing string includes a landing nipple 14. It is conventional practice in completing wells to include in the tubing string one or more landing nipples to facilitate the installation of tools as desired for working over or testing a well. The landing nipple 14 has a central opening extending longitudinally through it and an inner wall carefully machined or polished to permit sealing against the inner wall to prevent flow through the landing nipple. Landing nipples are ordinarily constructed of a corrosion-resistant alloy steel to maintain a smooth inner surface during the life of the tubing string. A locking recess 16 in the inner surface landing nipple allows a locking mandrel to be set in the landing nipple.

The locking mandrel indicated generally by reference numeral 18 has an inside fishing neck 20 at its upper end which is utilized as the locking mandrel is run into the tubing on a wire line and removed from the tubing after use of the locking mandrel has been completed. Other types of locking mandrels may have a different arrangement for running and pulling such as an external fishing neck. The locking mandrel includes locking dogs 22 urged outwardly by springs into the locking recess 16 in the landing nipple to secure the locking mandrel in the landing nipple. Sealing elements 24 around the outer surface of the locking mandrel engage the polished inner wall of the landing nipple to prevent flow between the outer surface of the locking mandrel and the landing nipple. Locking mandrels are commercially available equipment that are widely used in wells. A typical locking mandrel is the Type X Otis mandrel illustrated at page 4524 of the 1976–1977 Composite Catalog. The mandrels are made in a variety of sizes for use with tubing having internal diameters in the range of about one inch to seven inches, for example. Locking mandrels are run into, set in, and retrieved from, wells on a wire line.

Secured to the lower end of the locking mandrel is a locking assembly indicated generally by reference numeral 26. The locking assembly includes at its upper end an adapter 28 secured to the lower end of the locking mandrel by a threaded connection 30. The adapter has a central opening extending longitudinally therethrough that tapers from substantially the opening through the locking mandrel to a desired diameter designed to fit the stem of the tool of this invention, as hereinafter described. Preferably, the tapered central opening through the adapter is carefully machined or ground to provide a seat 32 adapted to receive a ball or plug to close the lower end of the locking mandrel, if such closure should be desired.

Figure 2:
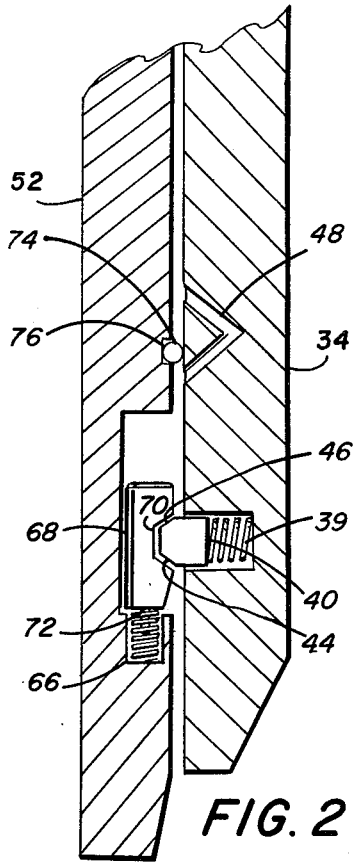
FIG. 2 is a diagrammatic fragmentary vertical sectional view of the locking and pressure release means of the tool in position to allow release of pressure preparatory to withdrawing the tool from the well.

Connected to the lower end of adapter 28 is a locking member 34. Locking member 34 is a tubular member, the outer surface of which is tapered at its lower end, as indicated at 36 to facilitate running the tool through the tubing. In the inner wall of the locking member 34 are a plurality of sockets 38 spaced at intervals around the locking member. Each socket 38 is adapted to receive a locking dog 40. The locking dogs are urged inwardly toward the central opening by compressed springs 39. The inner ends of the locking dogs 40 are tapered, as is best shown in FIG. 2, to provide sloping lower and upper shoulders 44 and 46, respectively, for movement of the locking dogs, as hereinafter described.

Figure 3:
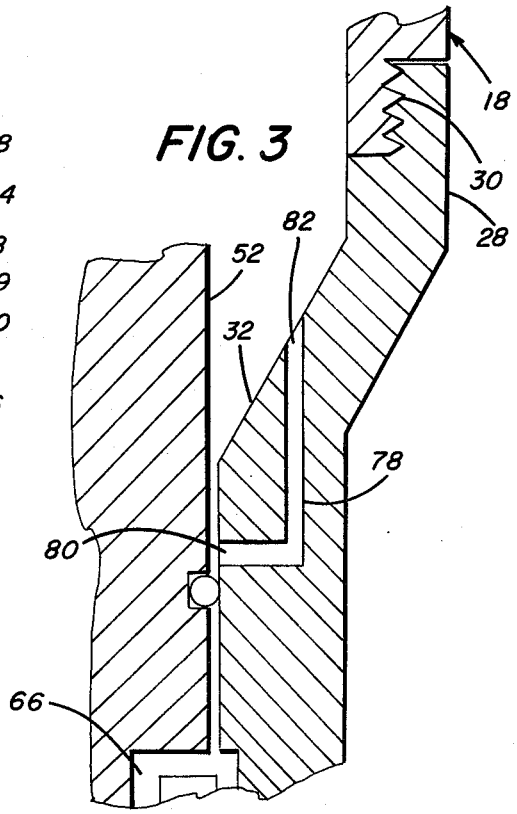
FIG. 3 is a vertical sectional view of a second embodiment of a pressure release passage.

Above the sockets 38 is a pressure equalizing passage 48 which opens through the inner surface of the locking member 34 at vertically spaced-apart positions. The pressure release passage 48 could be positioned below the cavity 38 or could be in the adapter 28, as illustrated in FIG. 3. It is preferred that the pressure equalizing passage be in the locking member 34 rather than in the adapter in order to keep the adapter structure simple and inexpensive because adapters of a number of different sizes will be required to service wells having different sizes of tubing, while a single locking member can be used for many sizes of tubing.

The tool includes a stem indicated generally by reference numeral 50 adapted to be run into the well on a wireline set in the locking mandrel and withdrawn from the well on a wireline after use of the tool is completed. The stem is an elongated cylindrical member 52 tapered at its lower end and having a central opening 54 extending longitudinally through it and opening through its lower end. In the embodiment shown, stem 52 is connected at its upper end to a hollow body 56 having a central chamber 58 adapted to receive an instrument to measure a well condition. In the embodiment shown, a pressure indicating device 60 is mounted in the chamber 56. Pressure indicating device 60 is connected by means of an electrically conducting wire 62 with indicating or recording means at the wellhead to give a direct reading at the wellhead of the pressure. The tool of this invention is adapted for measuring of a number of different well conditions and is not restricted to the determination of pressure at the level in the well of the tool. A temperature measuring instrument could, for example, be mounted in the chamber 58. In some instances, it may be desirable to have passages through the upper end of the chamber to permit flow of fluids through the opening 54 in the stinger 52 and outwardly into the tubing of the locking mandrel with a flow measuring device mounted in the chamber 58. The upper end of the tool is provided with a fishing head 64 to facilitate removal of the tool from the well; however, in some instances, line 62 may be adequate for running the tool into the well and lifting it from the well.

At the lower end of the stem 52 are a plurality of slots 66 in which locking dog receivers 68 are mounted at intervals around the stem for alignment with the locking dogs 40. The dog receivers have a notch 70 in their outwardly facing surface to receive dogs 40. The ends of the notch are slanted to conform to the ends of the dogs. Dog receivers 68 are urged upwardly in slots 66 by spring members 72. The outwardly facing surface of the dog receivers 68 below the notch 70 slants gradually inward to provide a cam surface 73 adapted to move the dogs 40 outwardly as the stem is run into the well.

Above the level of the slots 66 are sealing members 74 illustrated as O-rings mounted in a groove 76 around the stinger 52. The sealing members are positioned on the stem to engage the inner wall of the locking member just below the pressure equalizing passage 48 when the stem is locked in position.

In the operation of the tool of this invention, the locking mandrel 18 is assembled with the locking assembly 26 secured to its lower end and run into the well on a wireline. The locking mandrel is landed in the landing nipple by conventional procedure with the dogs 22 set in the recess 16 in the landing nipple. The stem 50 is assembled with the body 56 secured to its upper end and an instrument 60 mounted in the chamber 58 with the electric line 62 extending upwardly through the closed upper end of the body. The stem is lowered through the tubing into the locking mandrel 52 and the tapered lower end of the stem passes downwardly below the dogs 40 forcing the dogs 40 back into the sockets. As the lowering continues, the gradually tapered shoulder of the dog receivers 68 below the notches engages the upper surface 46 of the dogs 40 and forces the dogs into the sockets 58. When the stem is lowered to a point where the notches 70 in the dog receivers 68 are in alignment with the dogs 40, the compressed springs 39 force the dogs 40 into the notches 70 to lock the stem in place. The more abruptly sloping upper ends of the notches do not impart sufficient lateral force on the dogs to move them outwardly. When the stem is in this position, the O-ring 74 is below the pressure release passage 48 and bears against the inner wall of the locking member 34 to prevent flow between the locking mandrel and the stem. The stem is then in the position illustrated in FIG. 1 and is in condition for performing the desired test work on the well. The compressed spring 72 exerts sufficient downward force on the stem to prevent it from being moved upwardly by the difference in pressure of well fluids at the top and bottom of the stem.

When it is desired to remove the stem, the stem is lifted either by line 62 or by running a suitable tool downwardly through the well on a wire line to latch onto fishing head 64. The tool is lifted with a force adequate to compress the spring 72 to place the dog receivers 68 in the condition shown in FIG. 2 of the drawings. At that position, the O-ring 74 is above the lower end of the pressure release passage whereupon fluids from below the locking mandrel can flow upwardly through the pressure release passage 48 to equalize pressure above and below the locking mandrel. The stem is then lifted with a greater force whereupon the lower end of the notch 70 bears against the surface 44 of the locking dogs 40 to compress the springs 39 and move the locking dogs outwardly to allow withdrawal of the stem. After the stem has been pulled from the well, the locking mandrel can be removed by wire line operated tools now commercially available and conventionally used in well operations.

In the embodiment illustrated in FIG. 3, the pressure equalizing passage is located in the adapter rather than the locking member. Referring to FIG. 3, a pressure equalizing passage 78 is shown with its lower end opening through the cylindrical portion of the inner wall of the adapter at 80 and the upper end opening through the tapering portion of the inner wall at 82. The sealing means 76 are immediately below opening 80 when the stem is locked in position.

The setting of the tool in the locking mandrel facilitates running the tool into the well by avoiding the close tolerances through the tubing that would be necessary if the tool were set directly in the landing nipple. Danger of the tool becoming stuck in the hole either as it is run into the well or during retrieval is thereby eliminated. Although the locking mandrel necessarily has the close tolerances that are required as the result of sealing against the wall of the bore of the landing nipple without expanding the sealing means, the ruggedness of a locking mandrel permits it to be subjected to forces and blows to move it down the tubing that would destroy test instruments if such instruments were suspended from the locking mandrel and run into the well on the locking mandrel. Moreover, if a locking mandrel becomes stuck in the tubing and must be destroyed, its cost is far below the cost of instruments used in well testing procedures.

The tool can be run, set and retrieved on a wire line. Round trips with tubing can thereby be avoided as can the need for a derrick to run tubing into, or pull tubing from, the well. The wire line may be an electric line that runs to the surface and provides observation at the surface of conditions at the preselected level in the well during the testing operation.

An important advantage of the tool of this invention is that it can be set in most wells even though the wells may have been completed years ago. Most wells are completed with landing nipples in the tubing string. It is possible, therefore, to avoid making a round trip with tubing before, during, or after testing. After the testing tool and the locking mandrel have been retrieved by wire line, the tubing is fully open. The testing apparatus and method of this invention does not leave any obstruction to flow in the well that requires pulling the tubing to return the well to a full flow condition.

The "instrument" in the tool may be any of a wide variety of equipment. For example, the hollow body 56 may be empty and the tool then serve as a plug adapted to kill the well to permit work at the wellhead. The tool can then be pulled without removing the locking mandrel.

A single tool utilizing this invention can be used in the testing of wells having tubing from a wide range of sizes with only a change in the adapter being necessary. The adapters are very simple and inexpensive elements for connecting the locking member to the lower end of the mandrel. The locking member preferably has an internal diameter equal to the internal diameter of the smallest mandrel through which the stem 52 can be run. The adapter will then either be omitted or be a bushing for connecting the locking member to the mandrel without reduction in size of the central opening. The single locking member can be used with any locking mandrel of a larger size by installing an adapter that is connected at its upper end to the lower end of the mandrel and at its lower end to the upper end of the locking member.

Securing the locking member of this tool at the lower end of the locking mandrel allows conventional tools for running, setting, releasing and pulling locking mandrels to be used without modification. The small diameter of the central opening through the locking member that is essential to the use of a single size of locking member in a wide range of sizes of locking mandrels does not interfere with operations on the locking mandrel because of the location of the locking member below the locking mandrel.

I claim:

1. A wire line operated tool for testing a well adapted to be run on a wire line and suspended in a locking mandrel set in a landing nipple in tubing in the well comprising a tubular locking assembly secured to the lower end of the locking mandrel, a central opening extending longitudinally through the locking assembly, a socket in the locking assembly opening into the central opening, a stem adapted to be run on a wire line through the locking mandrel and into the locking assembly, a central opening extending longitudinally through the stem, a locking dog receiver in the stem, a locking dog in the socket movable radially therein between an inner locking position protruding from the socket into the locking dog receiver and an outer stem running position substantially entirely within the socket allowing the stem to be withdrawn, resilient means in the socket urging the locking dogs to the inner locking position in the locking dog receivers, sealing means extending around the stem and engaging the locking means to prevent flow between the stem and the locking means, a pressure equalizing passage in the locking assembly having its ends vertically spaced apart and opening into the central opening, said sealing means being positioned below the pressure equalizing passage when the stem is in the locking position with the locking dogs in the locking dog receivers to prevent flow into the pressure equalizing passage and to permit flow into the pressure equalizing passage on lifting the stem.

2. A wire line operated tool as set forth in claim 1 characterized by an outwardly facing notch in the locking dog receiver adapted to receive the locking dog, said notch in said locking dog receiver having sloping outwardly facing upper and lower end surfaces, and a gradually sloping outwardly facing lateral surface on the locking dog receiver below the notch, said surfaces being adapted to engage the locking dog and move the locking dog out of engagement with the locking dog receiver on vertical movement of the stem.

3. A wire line operated tool as set forth in claim 2 in which the outwardly facing lateral surface on the locking dog receiver slopes more gradually than the outwardly facing surfaces of the notch in the locking dog receiver whereby the outwardly facing lateral surface forces the locking dog outwardly as the stem is run into the locking means, and the upper outwardly facing end surface of the notch bears against the dog to support the stem in the operating position.

4. Apparatus as set forth in claim 1 characterized by the locking dog receiver being slidably mounted for vertical movement in the stem, and resilient means urging the locking dog receiver to an upper position whereby on lifting the stem the resilient means are compressed to allow upward movement of the stem to a position at which the sealing means are above the opening of the pressure equalizing passage into the central opening while retaining the locking dog in the locking dog receiver.

5. Apparatus as set forth in claim 1 characterized by means allowing limited upward movement of the stem without disengaging the locking dog from the locking dog receiver on lifting the stem with a first force, and means for disengaging the locking dog from the locking dog receiver upon lifting the stem with a second force exceeding the first force.

6. Apparatus as set forth in claim 1 in which the locking assembly includes an adapter secured at its upper end to the lower end of the locking mandrel and a locking member secured to the lower end of the adapter, the locking dog and resilient means urging the locking dog to the inner locking position being in the locking member.

7. A wire line operated tool as set forth in claim 6 characterized by the locking member having an internal diameter no larger than the diameter of the smallest locking mandrel in which the tool is used.

8. A wire line operated tool as set forth in claim 6 in which the pressure equalizing port is in the locking member.

9. A wire line operated tool as set forth in claim 6 in which the pressure equalizing port is in the adapter.

10. A wire line operated tool as set forth in claim 1 characterized by a hollow body at the upper end of the stem communicating with the central opening through the stem, and an instrument mounted in the hollow body for measuring a condition in the well.

11. A wire line operated tool as set forth in claim 10 characterized by the hollow body being closed at its upper end.

12. A wire line operated tool as set forth in claim 1 characterized by means at the upper end of the stem for lifting the stem from the locking mandrel on a wire line.

13. A well testing tool adapted to be run into, set, and retrieved from a well having a tubing string therein, a landing nipple in the tubing string and a locking mandrel set in the landing nipple, comprising a locking assembly secured to the lower end of the locking mandrel, said locking assembly having a central opening therethrough, a tubular stem having a central opening therethrough and having an outer diameter permitting running of the stem through the locking mandrel and into the locking assembly, sealing means around the stem adapted to prevent flow from the lower end of the locking mandrel to the upper end thereof between the stem and the locking mandrel, locking dogs in the locking assembly adapted to move radially between an inner locking position and an outer position permitting movement of the stem through the locking assembly, locking dog receiving means in the stem adapted to receive the locking dogs, resilient means in the locking assembly urging the locking dogs inwardly into the locking dog receiving means, sloping surfaces on the locking dogs and locking dogs receiving means constructed and arranged to compress the resilient means on lifting the stem to permit removal of the stem, and a pressure equalizing passage in the locking assembly having an inlet positioned immediately above the sealing means when the stem is locked in the locking assembly whereby on lifting the stem the inlet of the pressure release passage is uncovered to permit equalization of pressure above and below the locking mandrel.

14. A well testing tool as set forth in claim 13 characterized by the locking dog receiving means being slidable vertically in the stem, and resilient means urging the locking dog receiving means to an upper position whereby the stem may move upwardly to uncover the inlet of the pressure equalizing passage while maintaining the locking dogs in the locking dog receivers.

15. Well testing apparatus for a well having a tubing string therein and a landing nipple in the tubing string comprising a locking mandrel set in the landing nipple, a locking assembly having a central opening therethrough connected to the lower end of the locking mandrel, said locking assembly comprising an adapter at the upper end and a locking member secured to the lower end of the adapter, the central opening of the locking member being smaller than the central opening through the locking mandrel, a plurality of locking dogs slidably mounted in the locking member for radial movement therein, said locking dogs being positioned at spaced-apart intervals around the inner wall of the locking member, resilient means urging the locking dogs to an inner position, a stem having a central opening therethrough and an outer diameter allowing running of the stem into the locking member, locking dog receivers in the stem positioned to receive the locking dogs when the stem is lowered into the locking member, a pressure equalizing passage in the locking assembly, said pressure equalizing passage having an inlet into the central opening and an outlet spaced from and above the inlet, and sealing means engaging the outer surface of the stem and the inner wall of the locking assembly immediately below the inlet of the pressure equalizing passage to prevent flow between the stem and the locking assembly.

16. In a well testing tool adapted to be run into a well, set in a locking mandrel in the well and retrieved from the well on a wire line, said tool including a tubular stem that is run into the locking mandrel on a wire line, locked in the locking mandrel by locking dogs that move radially inward to prevent upward movement of the stem during the testing, is released by lifting by wire line, and is sealed around its periphery to prevent upward flow between the stem and the locking mandrel, the improvement comprising an adapter secured to the lower end of the locking mandrel, said adapter having a central opening therethrough, a locking member secured to the lower end of the adapter, said adapter and locking member having a central opening therethrough into which the tubular stem can be run on a wire line, said central opening in the locking member being of smaller diameter than the central opening of the mandrel, the radially moving locking dogs being located in the locking member, and springs in the locking member urging the locking dogs inwardly to lock the tubular stem in the locking mandrel, said springs being compressible to allow outward movement of the locking dogs on lifting the tubular stem on a wire line.

* * * * *